US007423614B2

(12) United States Patent
Hirakawa et al.

(10) Patent No.: US 7,423,614 B2
(45) Date of Patent: Sep. 9, 2008

(54) METHOD FOR DRIVING PLASMA DISPLAY PANEL

(75) Inventors: Hitoshi Hirakawa, Kawasaki (JP); Manabu Ishimoto, Kawasaki (JP); Kenji Awamoto, Kawasaki (JP)

(73) Assignee: Hitachi Plasma Patent Licensing Co., Ltd., Tokyo (JP)

( * ) Notice: Subject to any disclaimer, the term of this patent is extended or adjusted under 35 U.S.C. 154(b) by 570 days.

(21) Appl. No.: 10/999,068

(22) Filed: Nov. 30, 2004

(65) Prior Publication Data

US 2006/0022901 A1 Feb. 2, 2006

(30) Foreign Application Priority Data

Jul. 29, 2004 (JP) ..... 2004-222643

(51) Int. Cl.
*G09G 3/28* (2006.01)

(52) U.S. Cl. ..... 345/60; 345/204

(58) Field of Classification Search ..... 345/60, 345/67, 63, 72, 204
See application file for complete search history.

(56) References Cited

U.S. PATENT DOCUMENTS 6,512,501 B1 * 1/2003 Nagaoka et al. ..... 345/66
6,747,614 B2 6/2004 Takayama
2002/0135545 A1 * 9/2002 Akiba ..... 345/60

FOREIGN PATENT DOCUMENTS

| | | |
|---|---|---|
| JP | 2002-278510 | 9/2002 |
| KR | 10-2001-0097039 | 11/2001 |
| KR | 2001-97039 | 11/2001 |
| KR | 2004-58633 | 7/2004 |

OTHER PUBLICATIONS

Korean Official Communication issued in Korean Counterpart Application 10-2004-100973 dated May 8, 2006.
Chinese Official Communication dated Dec. 7, 2007 for corresponding Chinese Patent Application No. 2005100018881 (6 pages).

* cited by examiner

*Primary Examiner*—Amr Awad
*Assistant Examiner*—Stephen G Sherman
(74) *Attorney, Agent, or Firm*—Staas & Halsey LLP

(57) ABSTRACT

An address pulse width is reduced so that a display period for driving a plasma display panel (PDP) can be made longer. The PDP comprises cells, each cell having first and second electrodes covered with dielectric and a third electrode covered with dielectric disposed in a direction crossing the first and second electrodes. A method of driving the PDP comprises addressing ones of the cells to be illuminated for displaying, by applying, between the second and third electrodes of the respective cells to be illuminated, a preparatory address pulse having a pulse width that produces no discharge, and by subsequently applying therebetween main address pulses, each main address pulse having a pulse width that produces discharge.

3 Claims, 8 Drawing Sheets

METHOD FOR DRIVING PLASMA DISPLAY PANEL

FIELD OF THE INVENTION

The present invention relates generally to driving of a plasma display panel (PDP), and more particularly to application of address pulses during an address period in the PDP.

BACKGROUND ART

Takayama et al. disclose, in Japanese Unexamined Patent Publication JP 2002-278510 (A) (which corresponds to U.S. Pat. No. 6,747,614 B2), driving of the PDP which includes resetting for equalizing the wall voltages of a group of cell forming a display screen, addressing for controlling, in accordance with display data, potentials of groups of addressing electrodes crossing groups of displaying electrodes including scanning electrodes and sustaining electrodes, and sustaining light emission for applying sustaining voltages to cause the group of cells to produce discharge for displaying. In this PDP driving, the potentials are controlled differently for each of the groups of addressing electrodes (R, G and B) so that the brightness of discharge emissions during the resetting is equalized among the groups of cells having respective different discharge properties. This publication is incorporated herein by reference.

In the PDP, during an address period of time, addressing discharge is generated selectively between a plurality of addressing electrodes A's and a plurality of scanning electrodes Y's which cross each other, to thereby determine selected cells in which discharge occurs for displaying, and unselected cells in which discharge does not occur, so that discharge between the scanning electrodes Y's and the sustaining electrodes X's are generated during a display sustain period of time TS. Thus, high accuracy is required for this addressing discharge. For example, when address discharge does not occur in a particular cell to be caused to emit light, the cell does not emit light. When addressing discharge occurs in another particular cell to be inhibited from emitting light, the cell emits light undesirably. Thus, the quality of displaying is degraded when the accuracy of addressing discharge is insufficient. In a known method, the addressing voltage is raised or the address pulse width is expanded in order to improve the accuracy of addressing discharge.

SUMMARY OF THE INVENTION

In accordance with an aspect of the present invention, a plasma display panel includes cells, each cell having first and second electrodes covered with dielectric and a third electrode covered with dielectric disposed in a direction crossing the first and second electrodes, and a method of driving the plasma display panel comprises addressing ones of the cells to be illuminated for displaying, in which a preparatory address pulse having a pulse width that produces no discharge is applied between the second and third electrodes of the respective cells to be illuminated, and subsequently main address pulses are applied between the second and third electrodes, each main address pulse having a pulse width that produces discharge.

In accordance with another aspect of the invention, the plasma display panel has a screen that is made up of cells arranged in rows and columns. A method of driving the plasma display comprises selecting ones of the rows of cells one after another for addressing, in which first and second operations are effected. The first operation comprises applying, at one time between the second and third electrodes of all of the cells, preparatory address pulses having a pulse width that produces no discharge. The second operation comprises sequentially applying, between the second and third electrodes of ones of the cells of the rows that are to be illuminated for displaying, main address pulses on a row-by-row basis, each main address pulse having a pulse width that produces discharge, to thereby cause the cells to be illuminated for displaying to produce discharge for addressing.

In accordance with a further aspect of the invention, a method of driving a plasma display panel comprises: effecting a first operation of separating the screen of cells into a plurality of groups of cells, each group consisting of a plurality of rows of cells, and temporally staggering address periods of the plurality of respective groups of cells, and applying, at one time between the second and third electrodes of all of the cells of each group during the address period of each group, a preparatory address pulse having a pulse width that produces no discharge; and effecting a second operation of sequentially applying, between the second and third electrodes of ones of the cells of the rows of the group of cells that are to be illuminated for displaying, main address pulses on a row-by-row basis, each main address pulse having a pulse width that produces discharge, to thereby cause the cells to be illuminated for displaying to produce discharge for addressing.

DESCRIPTION OF THE PREFERRED EMBODIMENTS

In the known methods described above, when the addressing voltage is raised, a driver with a high-withstand-voltage and a mechanism for heat dissipation are required to be introduced, and hence the cost of the PDP is increased. Furthermore, when the address pulse width is expanded, a period of time for display discharging is restricted and the brightness and the number of the gray-scale levels are reduced. When, in order to improve these problems, the addressing electrodes are divided into two groups which are an upper group and a lower group and the number of address drivers is multiplied, the cost of the PDP is increased.

The inventors have recognized that, before discharge, there is a time delay between the moment of application of a voltage for starting discharge and the moment of actual starting the discharge, and that the presence of space charge reduces the voltage for starting discharge and the time delay of discharging.

An object of the present invention is to provide a shorter address period in driving the PDP by reducing the width of address pulses.

Another object of the invention is to provide a longer display period of time in driving the PDP.

A further object of the invention is to provide a higher quality of displaying in the PDP.

According to the invention, an address period in driving the PDP can be made shorter, thereby a display period can be made longer, and thereby the brightness and the number of gray-scale levels can be raised, to provide a higher quality of display.

The invention will be described with reference to the accompanying drawings. Throughout the drawings, similar symbols and numerals indicate similar items and functions.

Figure 1:
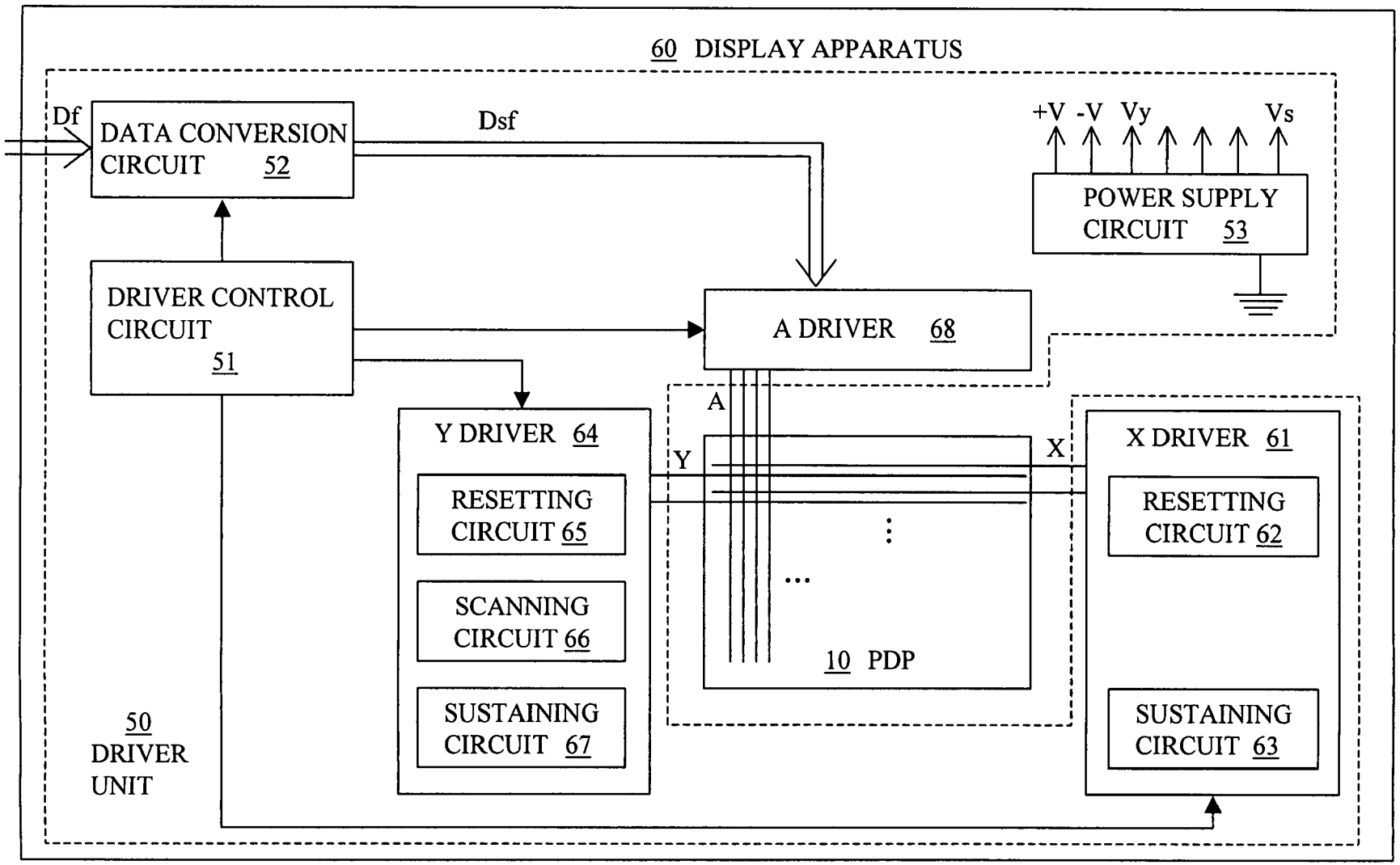
FIG. 1 shows a schematic arrangement of a display apparatus for use in an embodiment of the present invention.

FIG. 1 shows a schematic arrangement of a display apparatus 60 for use in an embodiment of the present invention. The display apparatus 60 includes a plasma display panel (PDP) 10 of the three-electrode surface discharge structure type having a display screen with m×n cells arranged in rows and columns, and a driver unit 50 for selectively controlling the cells to emit light. The display apparatus 60 is applicable to, for example, a television receiver, a monitor display of a computer system, and the like.

In the PDP 10, pairs of displaying electrodes X and Y, which generate discharges for displaying, are arranged in parallel to each other, and addressing electrodes A's are arranged such that the addressing electrodes A's cross the displaying electrodes X's and Y's. The displaying electrodes X's are sustaining electrodes, and the displaying electrodes Y's are scanning electrodes. The displaying electrodes X's and Y's typically extend in the row or horizontal direction of the display screen, and the addressing electrodes A's extend in the column or vertical direction.

The driver unit 50 includes a driver control circuit 51, a data conversion circuit 52, a power supply circuit 53, an X electrode driver circuit or X driver circuit 61, a Y electrode driver circuit or Y driver circuit 64, and an addressing electrode driver circuit or A driver circuit 68. The driver unit 50 is implemented in the form of an integrated circuit, which may possibly contain an ROM. A field of data Df representative of the magnitudes of light emission for the three primary colors of R, G and B is provided together with various synchronized signals to the driver unit 50 from an external device, such as a TV tuner or a computer. The field data Df is temporarily stored in a field memory of the data conversion circuit 52. The data conversion circuit 52 converts the field data Df into subfields of data Dsf for displaying in gradation, and provides the subfield data Dsf to the A driver circuit 68. The subfield data Dsf is a set of display data associating one bit with each cell, and the value for each bit represents whether or not each cell should emit light during the corresponding one subfield SF, or more particularly whether or not each cell should produce discharge for addressing.

The X driver circuit 61 includes a resetting circuit 62 for applying a voltage for initialization to the displaying electrodes X's to equalize the wall voltages in a plurality of cells forming the display screen of the PDP 10, and a sustaining circuit 63 for applying sustain pulses to the displaying electrodes X's to cause the cells to produce discharge for displaying. The Y driver circuit 64 includes a resetting circuit 65 for applying a voltage for initialization to the displaying electrodes Y's, a scanning circuit 66 for applying scan pulses to the displaying electrodes Y's for addressing, and a sustaining circuit 67 for applying sustain pulses to the displaying electrodes Y's to cause the cells to produce discharge for displaying. The A driver circuit 68 applies address pulses to the addressing electrodes A's designated in the subfield data Dsf in accordance with the displaying data.

The driver control circuit 51 controls the application of the pulses, and the transfer of the subfield data Dsf. The power supply circuit 53 supplies driving power to desired portions of the unit.

Figure 2:
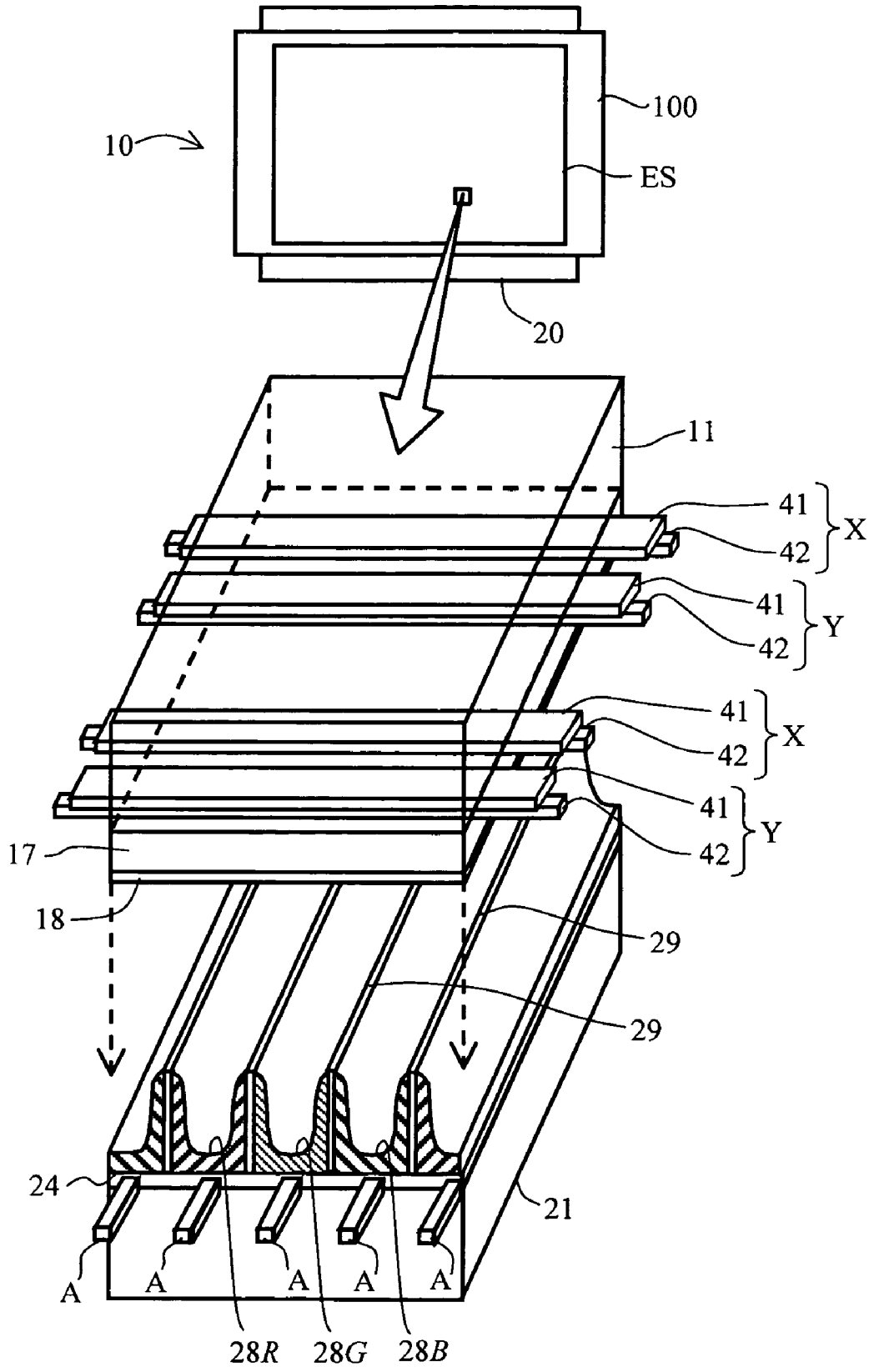
FIG. 2 shows an example of the cell structure of the PDP.

FIG. 2 shows an example of the cell structure of the PDP 10. The PDP 10 includes a pair of substrate structures (which have cell elements disposed on glass substrates) 100 and 20. On the inner surface of a front glass substrate 11, pairs of displaying electrodes X and Y are arranged in the respective rows of a display screen ES which has n rows and m columns. The displaying electrodes X's, and Y's are formed by transparent conductive films 41 forming a gap for surface discharge, and metal films 42 overlaid on the edge portions of the transparent conductive films 41, and are covered with a dielectric layer 17 and a protection layer 18. On the inner surface of a rear glass substrate 21, addressing electrodes A's are arranged in the respective rows, and these addressing electrodes A's are covered with a dielectric layer 24. Ribs or separating walls 29 partitioning the discharge spaces for the respective columns are provided on the dielectric layer 24. The ribs are arranged in a pattern of stripes. A layer of phosphors 28R, 28G, 28B for color display, which covers the front surface of the dielectric layer 24 and the inner side surfaces of the ribs 29, is locally excited by a UV ray radiated by a discharge gas of the cell, and emits visible light. The italics R, G and B in the figure indicate the colors of the emitted lights of the phosphors. The arrangement of the colors has a repeated pattern of R, G and B, in which the cells in each column exhibit the same color.

One picture typically has one frame period of approximately 16.7 ms. One frame consists of two fields in the interlaced scanning scheme, and one frame consists of one field in the progressive scanning scheme. In displaying on the PDP 10, for reproducing colors by the binary control of light emission, one field F in the time series, representative of an input image of one such field period, is typically divided into a predetermined number, q, of subfields SF's. Typically, each field F is replaced with a set of q subfields SF's. Often, the number of times of discharging for display for each subfield SF is set by weighting these subfields SF's with respective weighting factors of $2^0, 2^1, 2^2, \ldots, 2^{q-1}$ in this order. However, the weighting factors to be associated with the subfields SF's are not limited to the powers of two, as described above. $N(=1+2^1+2^2+\ldots+2^{q-1})$ steps of brightness can be provided for each color of R, G and B in one field by associating light emission or non-emission with each of the subfields in combination. In accordance with such a field structure, a field period Tf, which represents a cycle of transferring field data, is divided into q subfield periods Tsf's, and the subfield periods Tsf's are associated with respective subfields SF's of data. Furthermore, a subfield period Tsf is divided into a reset period TR for initialization, an address period TA for addressing, and a display or sustain period TS for emitting light. Typically, the lengths of the reset period TR and the address period TA are constant independently of the weighting factors for the brightness, while the number of pulses in the display period becomes larger as the weighting factor becomes larger, and the length of the display period TS becomes longer as the weighting factor becomes larger. In this case, the length of the subfield period Tsf becomes longer, as the weighting factor of the corresponding subfield SF becomes larger. However, the lengths of the reset period TR and the address period TA are not limited to those described above, and these lengths may be different for each subfield.

Figure 3:
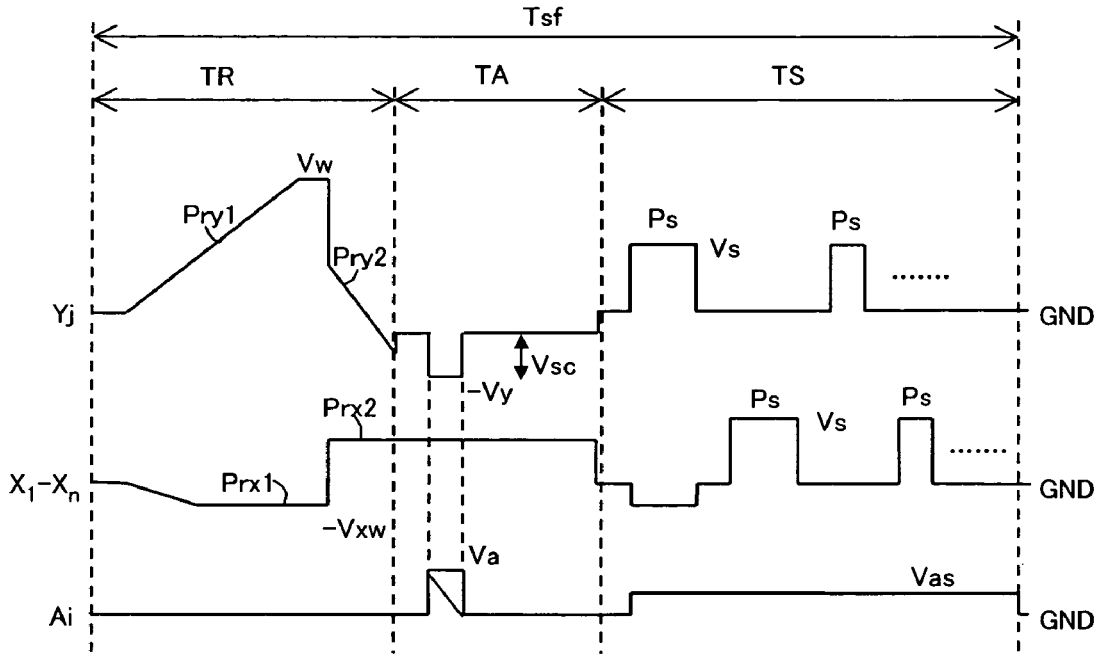
FIG. 3 shows a schematic conventional sequence of output driving voltage waveforms of an X driver circuit, a Y driver circuit and an A driver circuit.

FIG. 3 shows a schematic conventional sequence of output driving voltage waveforms of the X driver circuit 61, the Y driver circuit 64 and the A driver circuit 68. In this figure, the subscript j to the displaying electrodes X and Y indicates the position of an arbitrary row, and the subscript i to the addressing electrodes A indicates the position of an arbitrary column. The waveform shown is an example, and the amplitudes, polarities and timings of the waveforms may be varied differently.

q subfields SF's have the same order of a reset period TR, an address period TA and a sustain period TS in the driving sequence, and this sequence is repeated for each subfield SF. During a reset period TR of each subfield SF, a negative polarity pulse Prx1 and a positive polarity pulse Prx2 are applied in this order to all of the displaying electrodes X's, and a positive polarity pulse Pry1 and a negative polarity pulse Pry2 are applied in this order to all of the displaying electrodes Y's. The pulses Prx1, Pry1 and Pry2 have ramping waveforms having the amplitudes which gradually increase at the rates of variation that produce micro-discharge. The first pulses Prx1 and Pry1 are applied to produce, in all of the cells, appropriate wall voltages having the same polarity, regardless of whether the cells have been illuminated or unilluminated during the previous subfield. By applying the second pulses Prx2 and Pry2 in the cells having the appropriate wall charges, the wall voltages can be adjusted to have values which correspond to the differences between the respective discharge starting voltages and the pulse amplitude voltage. The pulses may be applied to only one of the groups of displaying electrodes X's and of the displaying electrodes Y's for initialization. However, the driver circuit elements are allowed to have lower withstand voltages by applying the pair of pulses having the respective opposite polarities, to the respective displaying electrodes X's and Y's as shown. The driving voltage applied to the cell is a combined voltage which is a sum of the amplitudes of the pulses applied to the respective displaying electrodes X and Y.

During the address period TA, wall charges required for sustaining illumination are formed only on the cells to be illuminated. While all of the displaying electrodes X's and of the displaying electrodes Y's are biased at the respective predetermined potentials, a negative scan pulse voltage −Vy is applied to a row of a displaying electrode Y corresponding to a selected row for each row selection interval (a scanning interval for one row of the cells). Simultaneously with this row selection, an address pulse voltage Va is applied only to addressing electrodes A's which correspond to the selected cells to produce address discharges. Thus, the potentials of the addressing electrodes $A_1$ to $A_m$ are binary-controlled in accordance with the subfield data Dsf for m columns in the selected row j. The selected cells produce discharges between their displaying electrodes Y's and addressing electrodes A's. The addressing discharges trigger or activate subsequent surface discharges between the displaying electrodes X's and Y's. A series of these discharges form the addressing discharge.

During the sustain period TS, a first sustain pulse Ps having a predetermined polarity (the positive polarity in the example shown in the figure) is applied to all of the displaying electrodes Y's. Then, the sustain pulse Ps is applied alternately to the displaying electrodes X's and the displaying electrodes Y's. The amplitude of the sustain pulse Ps corresponds to the sustaining voltage Vs. The application of the sustain pulse Ps produces surface discharge in the cells which have a predetermined amount of residual wall charge. The number of applied sustain pulses Ps's corresponds to the weighting factor of the subfield SF as described above. In order to prevent undesired vertical opposite discharge between the opposite A and X/Y electrodes during the entire sustain period TS, the addressing electrodes A's are biased at a voltage Vas having the same polarity as the sustain pulse Ps.

According to the embodiment of the invention, the PDP driver unit 50 applies pulses during the address period TA in a distinctive manner. The address period TA is made shorter, and thereby the stain period can be made longer to thereby provide a higher quality of display.

Figure 4:
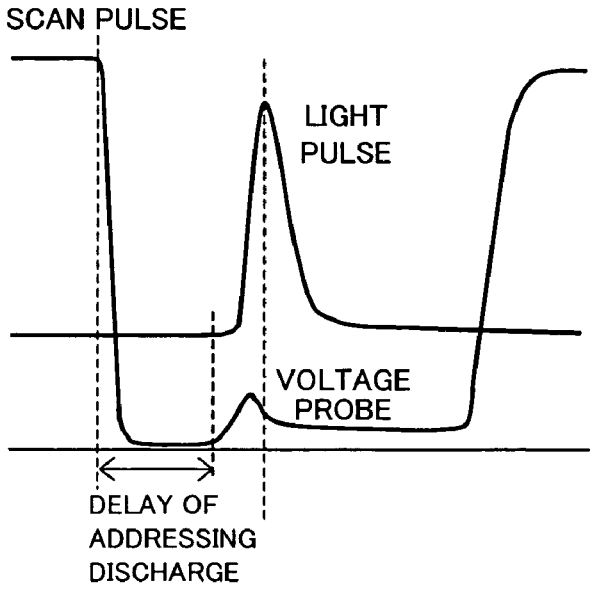
FIG. 4 shows a temporal relationship between the scan pulse and a light pulse of the address discharge obtained through actual measurement.

FIG. 4 shows a temporal relationship between the scan pulse and a light pulse produced by the address discharge, according to actual measurement. The light pulse of the address discharge in this figure represents a sum of the light magnitudes that can be observed for several cells, and does not represent the accurate temporal relationship. The time delay of discharge in this figure is better represented by the length of time between the moment of actually applying the scan pulse and the moment of actually starting the voltage drop of the scan pulse. Since the voltage drop represents the sign of discharge current flow, the starting point of the voltage drop indicates that discharge in a cell somewhere in one row of the scanning electrode Y has started. The observed voltage drop absorbs the voltage drop non-uniformity for one row of the cells, and is more accurate to evaluate the delay than the light pulse.

Discharge in the PDP involves a predetermined length of time delay between application of the voltages to the electrodes and the start of discharge. The process from the discharge to the emission of light in the PDP consists of (1) a discharge time delay phase or a discharge preliminary phase including application of an electric field to a discharge space, acceleration of electrons, and collisions of the electrons and gas atoms, and (2) a discharge and light emission phase including excitation and electrolytic dissociation of the gas atoms and emission of light. In the preliminary phase, priming particles such as space charges are produced in the discharge space in the cell, but discharge does not occur. This is so because, in the preliminary phase, charged particles such as electrons have not been sufficiently accelerated, and collision of the charged particles with the gas atoms causes neither electrolytic-dissociation and collision nor electron avalanche. The discharge and light emission start in the discharge and light emission phase after the priming particles have been generated. Thus, if the priming particles have been generated in advance, the voltage for starting discharge in the light emission phase is lowered, or the rise or start of the discharge appears shortly.

According to the embodiment of the invention, by applying a preliminary or preparatory address pulse in the preliminary phase to all of or a plurality of addressing electrodes A's simultaneously, the width of the main address pulses in the discharge and light emission phase is reduced to thereby the total length of the preparatory and main scan pulse widths is reduced.

For this purpose, by first applying a preparatory address pulse and a preparatory scan pulse before applying the main address pulses and the main scan pulses, the preparatory phase of the discharge phenomenon which occurs during the discharge time delay appears in advance. Thus the discharge time delay for the subsequent main address pulses and the main scan pulses is reduced. For the purpose of explanation in the description of the embodiments, the preparatory address pulse and the main address pulse in a narrow sense, which are applied to the addressing electrodes, are distinguished from the preparatory scan pulse and the main scan pulse, which hare applied to the scanning electrodes. However, the preparatory address pulse and the preparatory scan pulse may be collectively referred to as a "preparatory address pulse" in a broad sense, the main address pulse and the main scan pulse may be collectively referred to as a "main address pulse" in a broad sense, and the address pulse and the scan pulse may be collectively referred to as an "address pulse" in a broad sense. The wall charge formed on the addressing electrodes and the scanning electrodes is separated away therefrom by the preparatory address pulse and the preparatory scan pulse, so that space charge is supplied to the discharge space. Thus the space charge in the cell becomes abundant, and the statistical time delay of discharge is also expected to be improved because of the priming effect. Thus the widths of the main address pulse and the main scan pulse can be reduced relative to the widths of the conventional address and scan pulses.

Figure 5A:
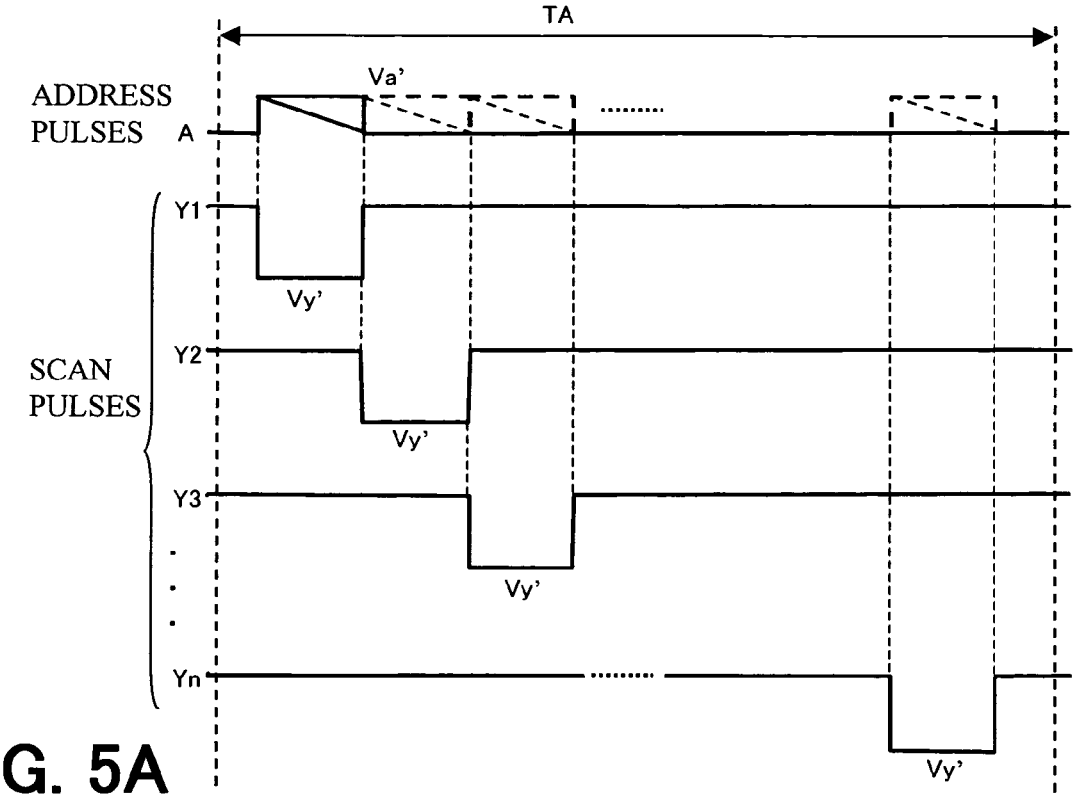
FIG. 5A shows a conventional time chart in which address pulses and scan pulses are applied one after another to the addressing electrodes and the scanning electrodes in the entirety of the PDP.

FIG. 5A shows a conventional time chart in which address pulses Va' and scan pulses Vy' are applied one after another to the respective addressing electrodes and the respective scanning electrodes in the entirety of the PDP 10.

Figure 5B:
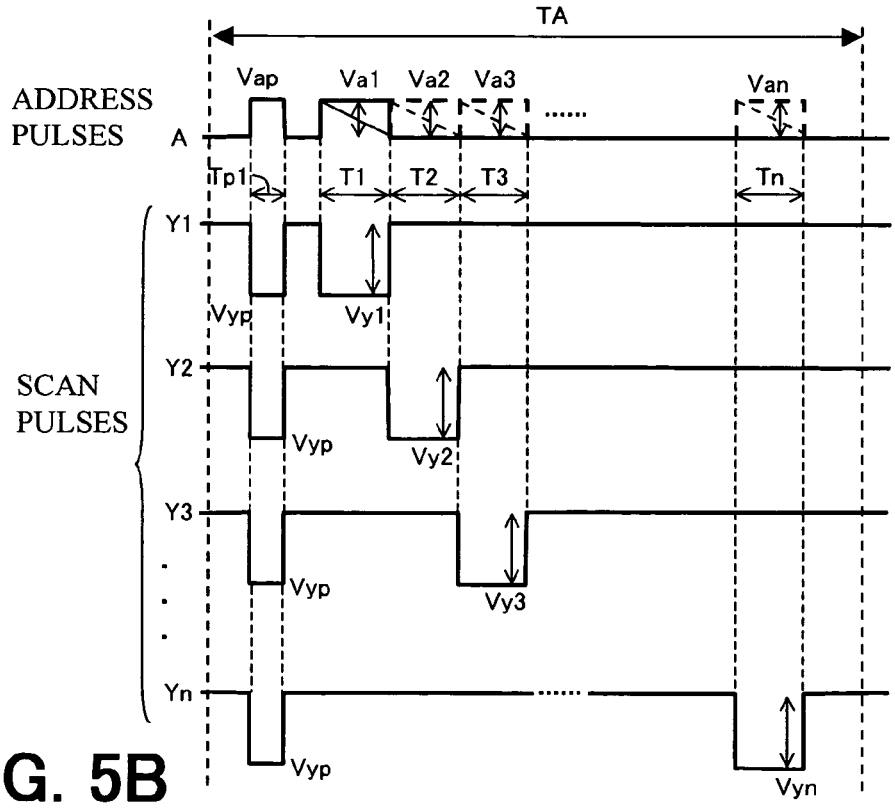
FIG. 5B shows a time chart of applying the preparatory address pulses and the preparation scan pulses at one time to the addressing electrodes and the scanning electrodes respectively in the entirety of the PDP, and then applying the main address pulses to them one after another, in accordance with the embodiment of the invention.

FIG. 5B shows a time chart of applying the preparatory address pulses Vap and the preparation scan pulses Vyp at one time to the addressing electrodes and the scanning electrodes respectively in the entirety of the PDP 10, and then applying the main address pulses Va1, Va2, . . . , Van and the main scan pulses Vy1, Vy2, . . . , Van to them respectively one after another, in accordance with the embodiment of the invention. In FIG. 5B, the width Tp1 of each of the preparatory address pulse Vap and the preparatory scan pulse Vyp is equal to or shorter than the discharge delay time, and hence no discharge is produced by the preparatory address pulse Vap or the preparatory scan pulse Vyp. The widths T1, T2, . . . , Tn of the main address pulses Va1, Va2, . . . , Van and the main scan pulses Vy1, Vy2, . . . , Van may be equal to each other. The heights of the main address pulses Va1, Va2, . . . , Van may be equal to each other. The heights of the main scan pulses Vy1, Vy2, . . . , Van may be equal to each other. Alternatively, as will be described later, during the address period TA, the widths T1, T2, . . . , Tn of the main address pulses Va1, Va2, Van and the main scan pulses Vy1, Vy2, . . . , Van may become gradually larger in this order. Alternatively, during the address period TA, the heights of the main address pulses Va1, Va2, . . . , Van and the main scan pulses Vy1, Vy2, . . . , Van may become gradually larger in this order.

Figure 6:
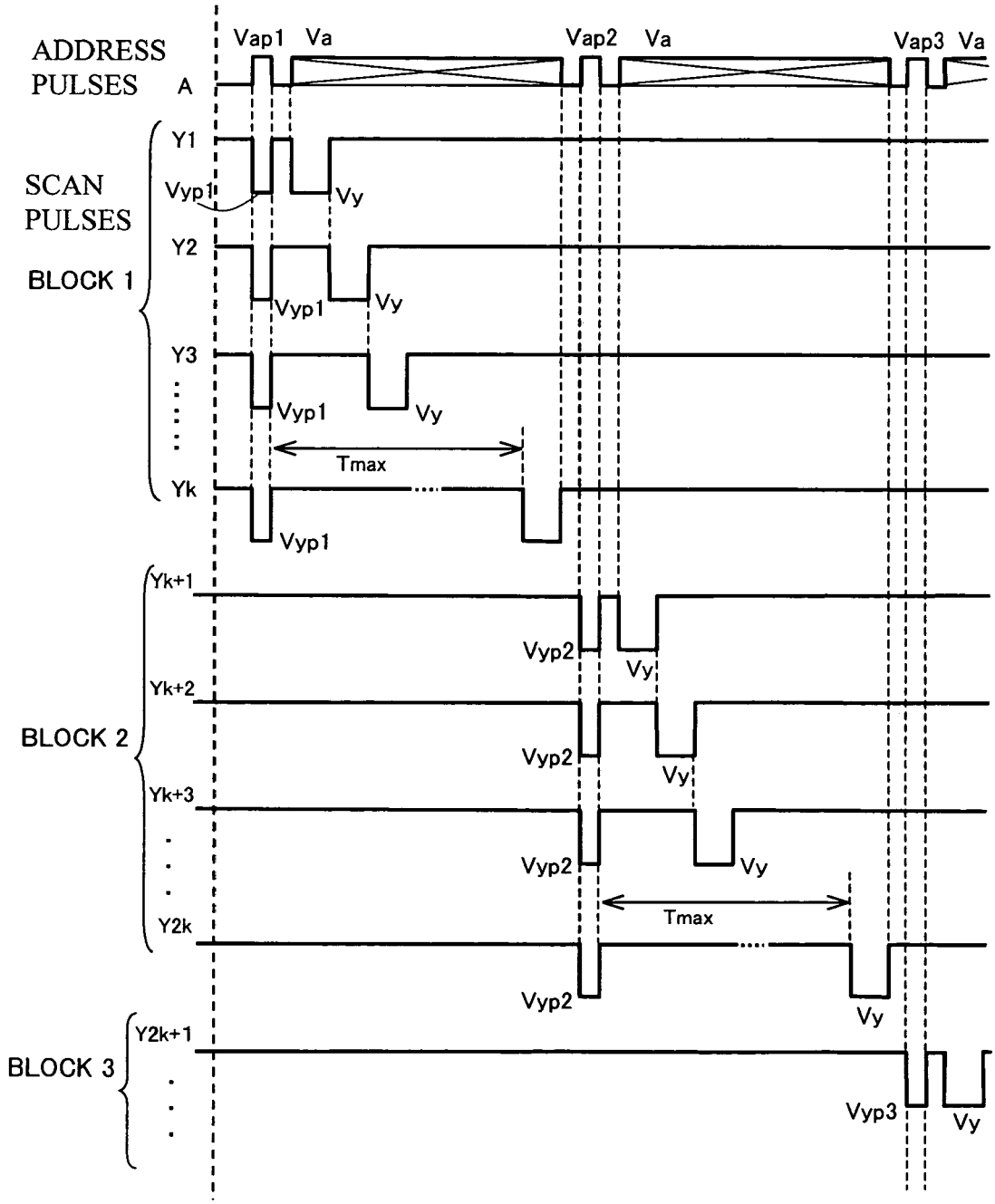
FIG. 6 shows a time chart of applying the preparatory address pulses and the preparatory scan pulses at one time to the addressing electrodes A's and the scanning electrodes Y's respectively, and then applying the main address pulses and the main scan pulses to them one after another, in which the scanning electrodes Y's of the PDP are grouped into a plurality of blocks, each block having k lines.

FIG. 6 shows a time chart of applying the preparatory address pulses Vap1 to Vap(n/k) and the preparatory scan pulses Vyp1 to Vyp(n/k) at one time to the addressing electrodes and the scanning electrodes respectively, and then applying the main address pulses Va and the main scan pulses Vy to them one after another, in which the scanning electrodes Y's of the PDP 10 are grouped into the number, n/k, of blocks 1 to n/k, each block having k rows (where k is an integer equal to or more than one). For example, the scanning electrodes Y's may be grouped into a block 1 consisting of the first to the (n/2)-th electrodes Y's and a block 2 consisting of the ((n/2)+1)-th to the n-th electrodes Y's, from the top of the PDP 10 (where n is an even number).

Figure 7:
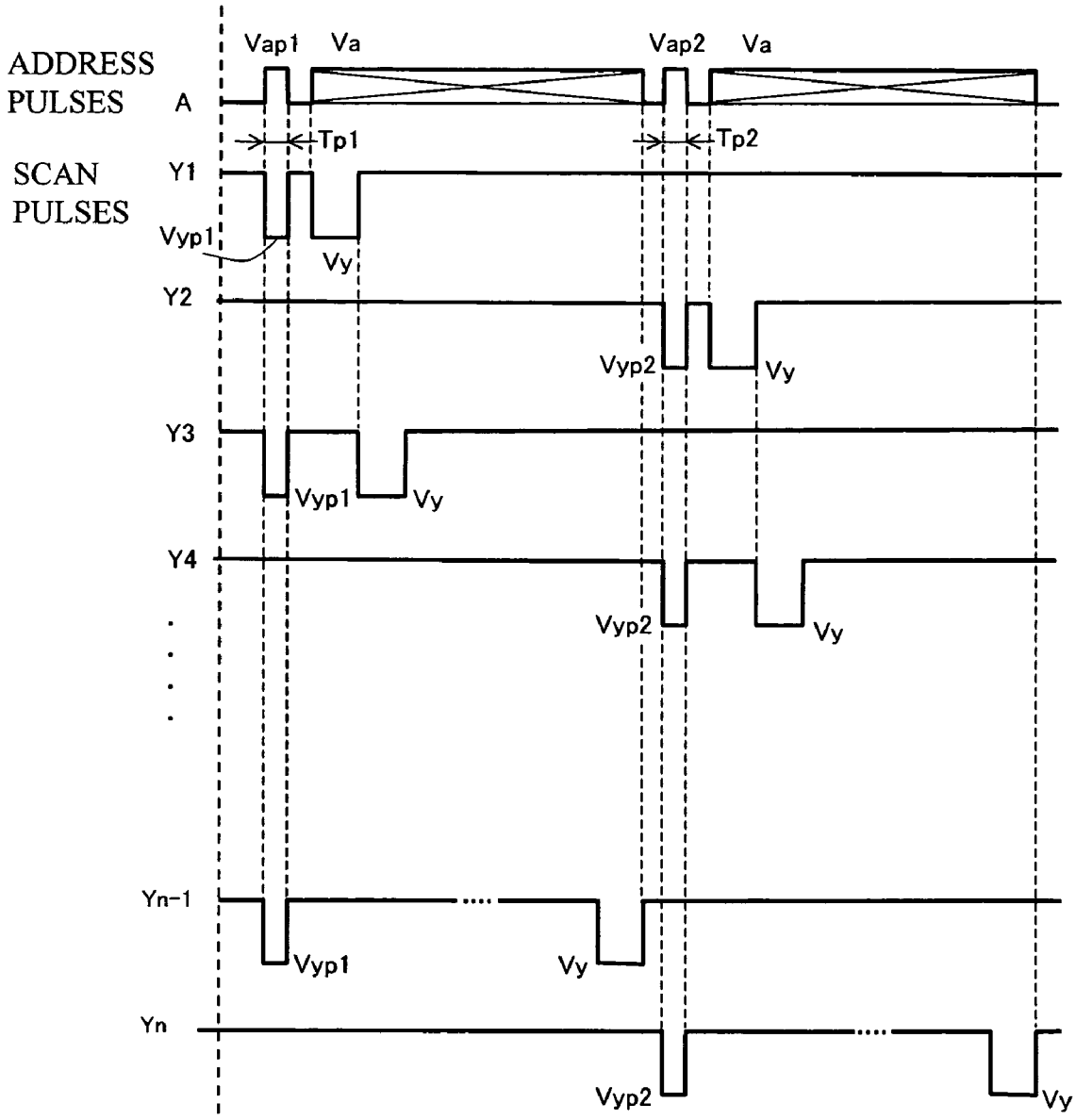
FIG. 7 shows a time chart of applying, in a first block, the preparatory address pulses and the preparatory scan pulses at one time to the addressing electrodes A's and the scanning electrodes Y's respectively, and then applying the main address pulses and the main scan pulses to them one after another, and then further applying, in a second block, the preparatory address pulses and the preparatory scan pulses at one time to the addressing electrodes and the scanning electrodes respectively, and then applying the main address pulses and the main scan pulses to them one after another, in which n scanning electrodes are grouped into the first block of odd numbered electrodes from the top of the PDP, and the second block of even numbered electrodes therefrom.

FIG. 7 shows a time chart of applying, in a first block, the preparatory address pulses Vap1 and the preparatory scan pulses Vyp1 at one time to the addressing electrodes A's and the scanning electrodes Y's respectively, and then applying the main address pulses Va and the main scan pulses Vy to them one after another, and then further applying, in a second block, the preparatory address pulses Vap2 and the preparatory scan pulses Vyp2 at one time to the addressing electrodes A's and the scanning electrodes Y's respectively, and then applying the main address pulses Va and the main scan pulses Vy to them one after another, in which the number, n, of scanning electrodes Y's are grouped into the first block consisting of the odd numbered electrodes from the top of the PDP 10, and the second block consisting of the even numbered electrodes therefrom.

For example, the peak value Va of the address pulse is determined as Va=80V, the peak value Vy of the scan pulse is determined as Vy=−170V, the peak value Vap of the preparatory address pulse is determined as Vap≦80V, and the peak value Vyp of the preparatory scan pulse is determined as Vyp≧−170V.

The polarities of the preparatory address pulses at the addressing electrodes and the preparatory scan pulses at the scanning electrodes are the same as the polarities of the main address pulses and the main scan pulses.

The peak values Vap and Vyp of these pulses are required to satisfy the following formula.

$$(|Vap|+|Vyp|)\leqq(|Va|+|Vy|)$$

where the symbol "| |" represents an absolute value.

The pulse widths of these pulses are required to be determined to have a length of time shorter than the delay time of forming discharge, so that discharge is not produced by the preparatory address pulses and the preparatory scan pulses. In view of the non-uniformity among the cells in the entirety of the PDP 10, the pulse width is the length of approximately 500 ns or shorter, and more preferably 300 ns or shorter. The pulse widths of the main address pulses and the main scan pulses are typically longer than the widths of the preparatory address pulse, and are preferably about 1 μs.

The conventional widths of the address pulses and the scan pulses are in the range of 1 to 33 μm. In contrast, in accordance with the embodiment of the invention, the sum of the widths of the first preparatory address pulse and the next main address pulse in each of the blocks, 0.3μ+1.0 μs=1.3 μs, is equal to the width of the first conventional address pulse. However, the width of each of the main address pulses subsequent to the second main address pulse, in accordance with the embodiment of the invention, is shorter by a difference 0.3 μs than the conventional pulses, so that the widths in one block can become considerably shorter.

In FIG. 6, the number, k, of the scanning electrodes Y's in one block is ideally determined to be an integer, which is derived by dividing, by the width of the scan pulse, the upper limit Tmax of the period of time during which the priming effect maintains after the application of the preparatory pulse. However, for simplification of the circuit arrangement, the number, k, of the line electrodes in one block may be determined to be the number of output bits of one Y driver circuit 64. For providing the preparatory pulses to the electrodes in one selected block, it is desirable that the potentials of the scanning electrodes in the other blocks are kept at a standby potential (a semi-selected potential, i.e. the potential of Vsc in FIG. 3) during the address discharge, as represented by the following formula, so that the preparatory pulse is not provided to the other blocks.

The Potential of the Selected Block (|Vap|+|Vyp|)>the Potential of Other Block (|Vap|+|Vsc|)

Figure 8:
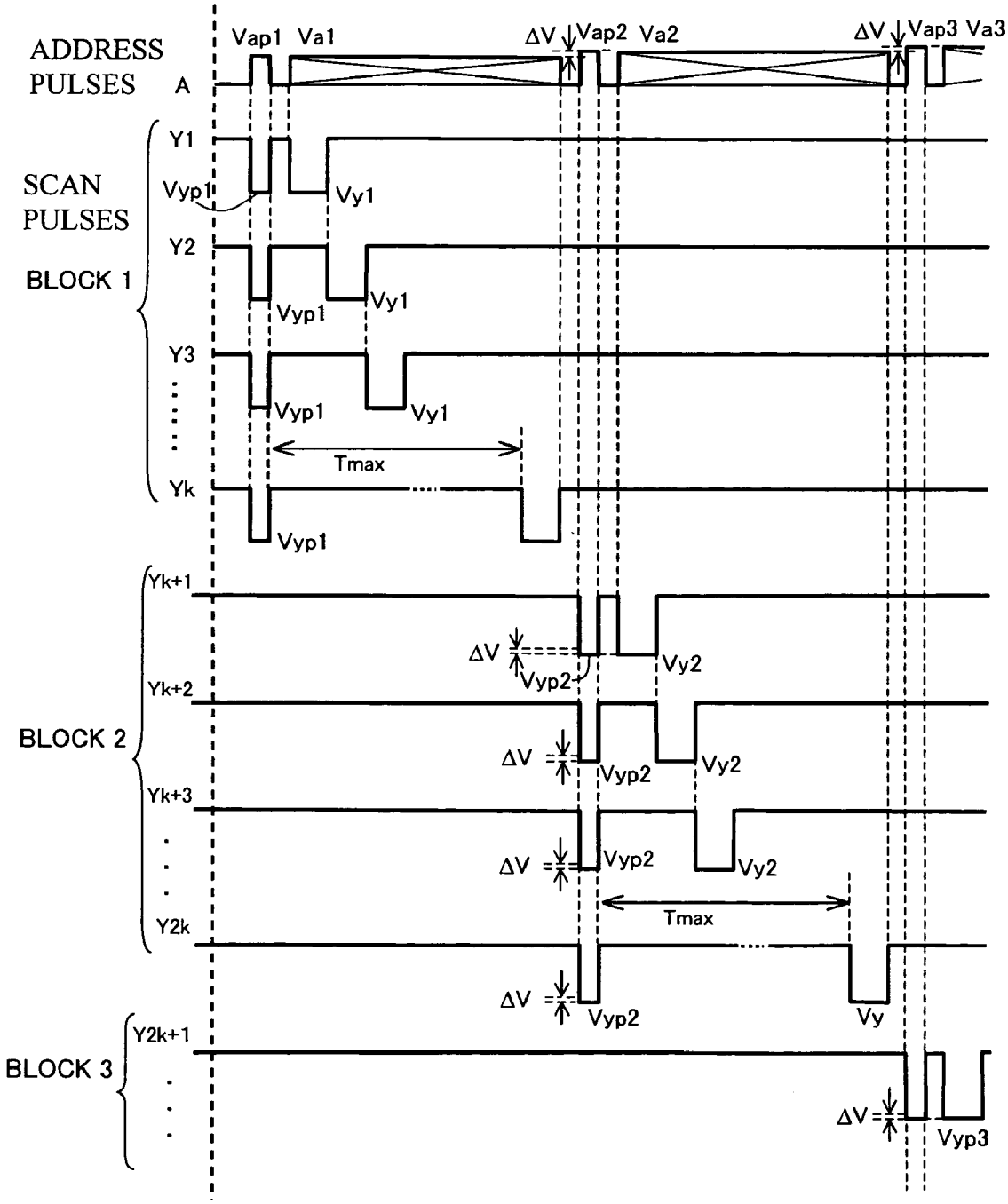
FIG. 8 is a modification of the time chart of FIG. 6, and shows a time chart, in which the heights of the preparatory address pulses and the preparatory scan pulses are gradually made larger from one block after another for the consecutive blocks of one field.

FIG. 8 is a modification of the time chart of FIG. 6, and shows a time chart, in which the heights of the preparatory address pulses Vap1, Vap2, Vap3, . . . and the preparatory scan pulses Vyp1, Vyp2, Vyp3, . . . are gradually made larger by a difference ΔV from one block after another for the consecutive blocks of one field. In this case, the heights of the main address pulses Va1, Va2, Va3, . . . are preferably determined to be the same as the heights of the respective preparatory address pulses Vap1, Vap2, Vap3, . . . in the respective blocks 1, 2, 3, . . . , and the heights of the main scan pulses Vy1, Vy2, Vy3, . . . , are preferably determined to be the same as the heights of the respective preparatory scan pulses Vyp1, Vyp2, Vyp3, . . . in the respective blocks 1, 2, 3, . . . , as shown in the figure. Alternatively, all of the heights may be the same throughout all the blocks rather than the gradual change.

Figure 9:
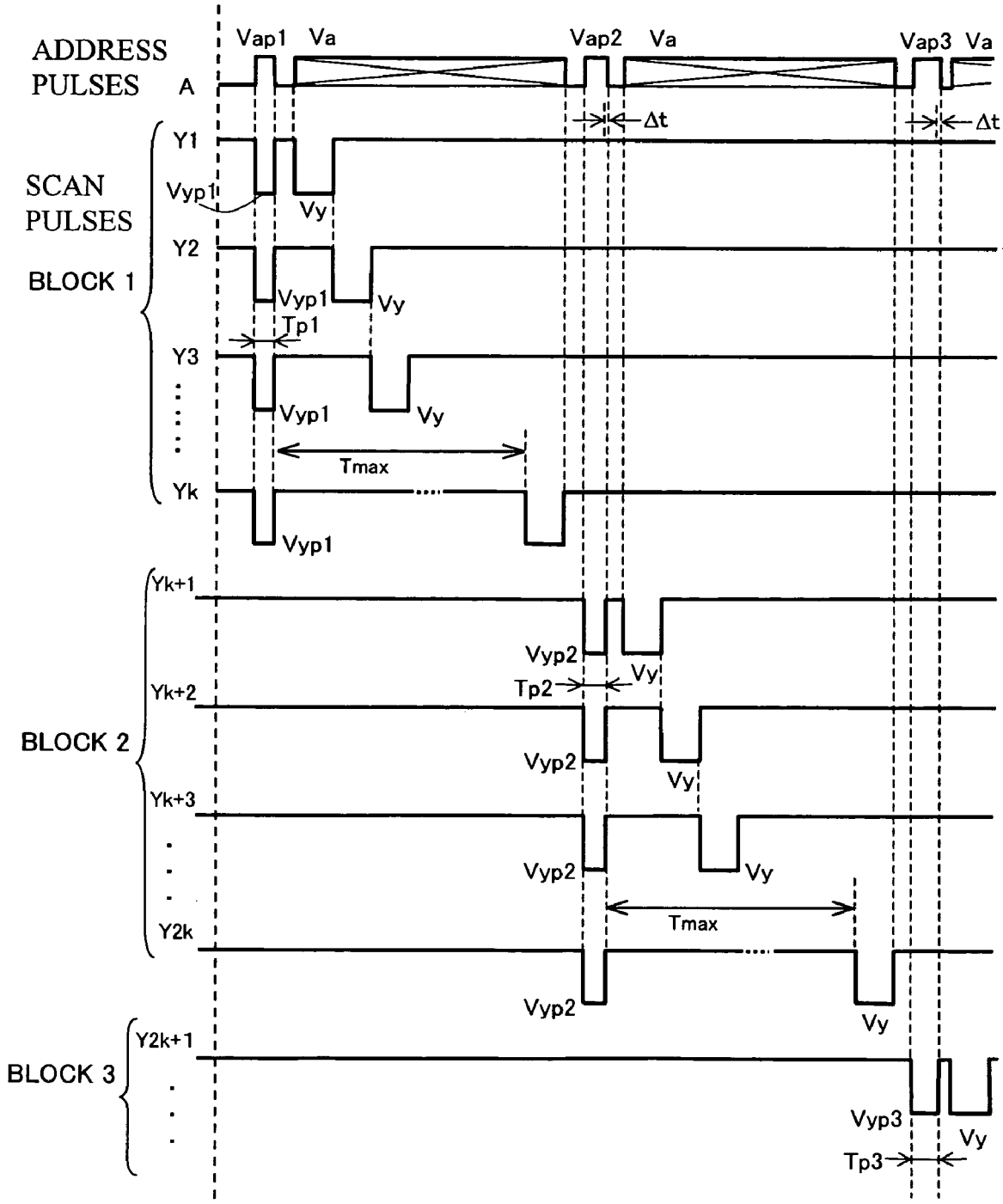
FIG. 9 is another modification of the time chart of FIG. 6 and shows a time chart, in which the widths of the preparatory address pulses and the preparatory scanning pulses are gradually made larger from one block to another for the consecutive blocks of one field.

FIG. 9 is another modification of the time chart of FIG. 6 and shows a time chart, in which the widths Tp1, Tp2, Tp3, . . . of the preparatory address pulses Vap1, Vap2, Vap3, . . . and the preparatory scanning pulses Vyp1, Vyp2, Vyp3, . . . are gradually made larger by a difference Δt from one block to another for the subsequent blocks of one field. In this case, the widths of the main address pulses Va and the main scan pulses Vy through the blocks 1, 2, 3, . . . may be equal to each other.

In general, the wall charge tends to reduce spontaneously as the time elapses after the reset period TR and the discharge delay time tends to become longer. Thus, in order to compensate this reduction, as shown in FIGS. 8 and 9, in the blocks 2, 3, . . . , n/k subsequent to the block 1, the pulse width Tp2 and/or the peak values of the preparatory address pulse Vap2 and the preparatory scan pulse Vyp2 are made larger than the pulse width Tp1 and the peak values of the preparatory address pulse Vap1 and the preparatory scan pulse Vyp1, and the pulse width Tp3 and/or the peak values of the preparatory address pulse Vap3 and the preparatory scan pulse Vyp3 are made larger than the pulse width Tp2 and the peak values of the preparatory address pulse Vap2 and the preparatory scan pulse Vyp2, and so on. Thus, the pulse width and/or the peak values may be made larger for the preparatory address pulse Vap and the preparatory scan pulse Vyp in a latter block. For example, when the scanning electrodes Y's are grouped into five blocks, the width of the preparatory address pulse and the preparatory scan pulse in the first block may be set to be 110 ns and raised by a difference Δt=10 ns for each subsequent block, and the width of the preparatory address pulse and the preparatory scan pulse in the fifth block may be determined to be 150 ns. For example, for these five blocks, the peak value of the preparatory scan pulse may be −166V for the first block and made larger by a difference ΔV=1V for each subsequent block, so that the peak value of the preparatory address pulse and the preparatory scan pulse may be −170V for the fifth block.

In FIG. 5B, during the address period TA, the height of the main address pulses Va1, Va2, Va3, . . . , Van after the preparatory address pulse Vap, and the height of the main scan pulses Vy1, Vy2, Vy3, . . . , Vyn after the preparatory scan pulse Vyp may be gradually made larger by a difference ΔV, and/or the pulse widths T1, T2, . . . , Tn thereof may be gradually made larger by a difference Δt. Alternatively, the heights and/or widths may be gradually made larger for the main address pulses and the main scan pulses which occur at the timings after the upper limit period of time Tmax during which the priming effect maintains after the moment of applying the preparatory pulse.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. A method of driving a plasma display panel, said plasma display panel comprising cells, each cell having first and second electrodes covered with dielectric and a third electrode covered with dielectric disposed in a direction crossing the first and second electrodes, said plasma display panel having a screen that is made up of cells arranged in rows and columns, said method comprising;

selecting one of the rows one after another for addressing, comprising:

effecting a first operation of applying, at the same time between the second and third electrodes of all of the cells in the screen, respective preparatory address pulses, each pulse having a pulse width of 500 ns or less that produces no discharge; and effecting a second operation of sequentially applying, between the second and third electrodes of a cell of one of the rows that are to be illuminated for displaying, main address pulses on a row-by-row basis, each main address pulse having a pulse width that produces discharge, thereby causing the cells to be illuminated for displaying to produce respective discharges for addressing.

2. A method of driving a plasma display panel, said plasma display panel comprising cells, each cell having first and second electrodes covered with dielectric and a third electrode covered with dielectric disposed in a direction crossing the first and second electrodes, said plasma display panel having a screen that is made up of cells arranged in rows and columns, said method comprising:

effecting a first operation of separating said screen of cells into a plurality of groups of cells, each group consisting of a plurality of rows of cells, and temporally staggering address periods of the plurality of respective groups of cells, and applying, at the same time between the second and third electrodes of all of the cells in each group during the address period of each group, respective preparatory address pulses, each pulse having a pulse width of 500 ns or less producing no discharge; and effecting a second operation of sequentially applying, between the second and third electrodes of a cell in one of the rows in one of the groups that is to be illuminated for displaying, main address pulses on a row-by-row basis, each main address pulse having a pulse width that produces discharge, to thereby causing the cells to be illuminated for displaying to produce respective discharges for addressing.

3. The method of driving a plasma display panel according to claim 2, wherein the preparatory address pulse for each group has a peak value or a pulse width which is larger than a peak value or a pulse width of a preparatory address pulse for an anteceding group.

* * * * *

UNITED STATES PATENT AND TRADEMARK OFFICE

CERTIFICATE OF CORRECTION

PATENT NO. : 7,423,614 B2
APPLICATION NO. : 10/999068
DATED : September 9, 2008
INVENTOR(S) : Hitoshi Hirakawa et al.

It is certified that error appears in the above-identified patent and that said Letters Patent is hereby corrected as shown below:

Column 10, Line 32, change “comprising;” to --comprising:--.

Signed and Sealed this

Twentieth Day of January, 2009

JON W. DUDAS
*Director of the United States Patent and Trademark Office*